United States Patent [19]

Imamura

[11] 4,019,646

[45] Apr. 26, 1977

[54] CAP WITH INSIDE STOPPER FOR RECEPTACLE

[75] Inventor: Masanaga Imamura, Tokyo, Japan

[73] Assignee: Ricoh Co., Ltd., Tokyo, Japan

[22] Filed: Jan. 19, 1976

[21] Appl. No.: 650,315

[30] Foreign Application Priority Data

Jan. 23, 1975 Japan ..... 50-10178

[52] U.S. Cl. ..... 215/329; 215/354

[51] Int. Cl.[2] ..... B65D 41/28

[58] Field of Search ..... 215/329, 341, 350, 354; 220/288

[56] References Cited

UNITED STATES PATENTS

| | | | |
|---|---|---|---|
| 406,005 | 6/1889 | Shepherd | 215/329 |
| 1,910,913 | 5/1933 | Conner | 215/350 |
| 2,206,118 | 7/1940 | Pahls | 215/354 X |
| 3,709,395 | 1/1973 | Brennan | 215/329 X |
| 3,924,772 | 12/1975 | Magnani | 215/354 X |

FOREIGN PATENTS OR APPLICATIONS

| | | | |
|---|---|---|---|
| 547,660 | 5/1956 | Belgium | 215/350 |

*Primary Examiner*—Donald F. Norton

*Attorney, Agent, or Firm*—Woodhams, Blanchard and Flynn

[57] ABSTRACT

A cap for receptacles provided with an inside stopper, wherein the inside of the side-wall of the cap is threaded so as to fit on the threaded side-wall of the opening of the receptacle and the inside stopper is provided with a side-wall whose outside diameter is equal to or slightly greater than the inside diameter of the opening of the receptacle and is provided with a flange on the upper end of said side-wall and having an outside diameter smaller than the inside diameter of the cap. The inside stopper is securely attached to the cap so as to be free from slipping out therefrom.

9 Claims, 8 Drawing Figures

CAP WITH INSIDE STOPPER FOR RECEPTACLE

BACKGROUND OF THE INVENTION a. Field of the Invention

The present invention relates to an improved cap with an inside stopper for use in receptacles, and particularly relates to an improved cap with an inside stopper, wherein said inside stopper is designed to fit in the opening of the receptacle to enhance the tight sealing effect while the cap proper and the inside stopper are detachable from said opening simultaneously or separately at the time of using the receptacle.

b. Description of the Prior Art

There have hitherto been proposed various modes of caps with an inside stopper for use in receptacles and which are intended to be superior in the tight sealing effect. However, as a matter of fact, none of the caps of this kind available on the market at present has proved satisfactory to meet the demand of users to perfection. For instance, the commercially available cap shown in FIG. 8 wherein the inside stopper and the cap proper are detached separately is not easy to handle. In the case of a cap wherein the cap proper and the inside stopper are formed as an integral unit it is defective in that there frequently occurs an offset between the centers of the cap and the inside stopper, causing a gap to exist between the exterior of the side-wall of the inside stopper and the inside wall of the opening of the receptacle and leakage of the liquid contained in the receptacle proper through said gap.

In the meantime, various studies of caps giving priority to achievement of a tight-sealing effect thereof have also been made. But, the caps proposed as the result of those studies have been defective in that they are very intricate in construction, requiring a high technical skill in manufacturing thereof.

SUMMARY OF THE INVENTION

One object of the present invention is to provide a cap with an inside stopper accommodated therein for use in a receptacle, which is so designed that the inside stopper is detachable simultaneously with the cap proper and is easy to handle. Another object of the present invention is to provide a cap with an inside stopper accommodated therein for use in a receptacle, which is simple in construction and easy to manufacture and is superior in the tight-sealing effect.

The present invention provides a cap with an inside stopper accommodated therein for use in a receptacle, wherein the inside of the side-wall of the cap proper is threaded so as to fit on the threaded side-wall of the opening of the receptacle and said inside stopper is provided with a side-wall whose outside diameter is equal to or slightly greater than the inside diameter of the opening of the receptacle, together with a flange on the upper end of said side-wall and having an outside diameter smaller than the inside diameter of said cap proper, said inside stopper being securely accommodated in the cap proper so as to be free from slipping out therefrom.

BRIEF DESCRIPTION OF THE DRAWING

In the appended drawings.

Figure 1:
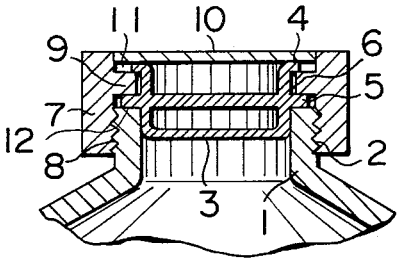
FIG. 1 is a cross-sectional view of the condition of the cap with an inside stopper according to the present invention as fitted on the receptacle.
Figure 2:
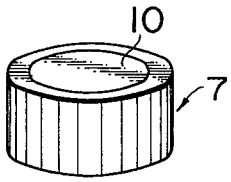
FIG. 2 to FIG. 4 are respectively a perspective view of the external appearance of the cap proper and the inside stopper detached from the opening of the receptacle.
Figure 3:
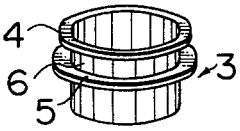
Figure 4:
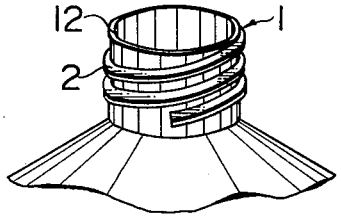

Referring to the reference numerals in these drawings, 1 denotes the opening of the receptacle, 2 denotes the thread provided on the exterior of the opening 1 of the receptacle, 3, 3′ denote the inside stopper, 4, 5, 13 denote the flange, 6 denotes the circular groove, 7, 7′ denote the cap proper, 8 denotes the thread provided on the inside of the side-wall of the cap proper, 9 denotes the circular projection, 10 denotes the lid member of the cap proper, 11 denotes the top recess of the cap proper 7, 12 denotes the top face of the opening 1 of the receptacle, and 14 denotes the hook member of the cap proper 7′ for holding the inside stopper.

DETAILED DESCRIPTION OF THE INVENTION

As described above, in the cap with an inside stopper for use in a receptacle, according to the present invention, the inside stopper is securely accommodated in the cap proper so as to be free from slipping out therefrom. Besides, due to interrelation between the inside diameter of the opening of the receptacle and the outside diameter of the side-wall of the inside stopper, as well as interrelation between the inside diameter of the cap proper and the outside diameter of the flange of the inside stopper, the inside stopper can move transversely relative to the cap proper, and at the time when the cap is fitted on the receptacle, the center of the cap proper comes to coincide with the center of the inside stopper automatically thereby to bring about an excellent tight sealing effect.

Figure 7:
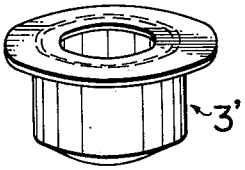
FIG. 7 is a perspective view of the external appearance of the inside stopper shown in FIG. 5.
Figure 8:
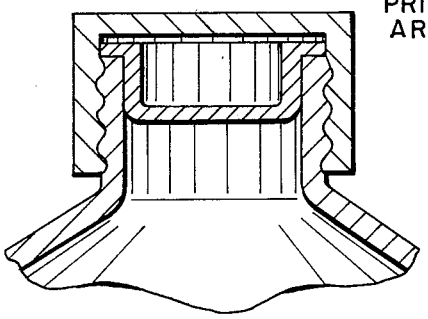
FIG. 8 PRIOR ART
FIG. 8 is a cross-sectional view of a conventional cap with an inside stopper as applied on the receptacle.

The present invention can be embodied in the following two typical modes of practice. The first embodiment (FIGS. 1–4) comprises a cap, with an inside stopper 3. The inside of the side-wall of the cap proper is threaded at 8 so as to fit on the threaded side-wall 2 of the neck of the receptacle and is also provided with a circular projection 9 formed above the threaded portion 8. The inside stopper 3 is provided with a side-wall whose outside diameter is equal to or slightly greater than the inside diameter of the opening of the receptacle 1. The inside stopper 3 has a pair of flanges 4 and 5 toward the upper end of said side-wall and the outside diameters of said flanges are smaller than the inside diameter of the cap 7. The inside stopper 3 is located in the cap 7 by fitting the circular projection 9 of the cap into the circular groove 6 defined between the flanges 4 and 5 so as to be slightly movable transversely. The second embodiment (FIGS. 5–7) comprises a cap 7 with an inside stopper, 3′. The inside of the side-wall of the cap 7 is threaded so as to fit on the threaded side-wall 8 of the next of the receptacle while the inside of the top-wall thereof is provided with a hook member 14 for holding the inside stopper 3′. The inside stopper 3 is provided with a side-wall whose outside diameter is equal to or slightly greater than the inside diameter of the opening of the receptacle and with a flange 13 which is located at the upper end of said side-wall and has an outside diameter smaller than the inside diameter of the cap 7'. The flange 13 has a central opening whose inside diameter is smaller than the maximum width of the hook member 14 for holding the inside stopper. The inside stopper 3' is disposed in the cap 7' in such a fashion that the lower end of the hook member 14 provided on the cap 7 is disposed within the inside stopper.

Hereunder will be given full particulars of the present invention with reference to the embodiments illustrated in the appended drawings.

The inside stopper 3 shown in FIG. 1 (and FIG. 3) a one piece member made of a thermoplastic resin such as polyethylene, polyvinyl chloride, etc. and is somewhat resilient so that it can be fitted in the opening 1 of the receptacle. This inside stopper 3 is provided with two flanges 4, 5 which extend outwardly and which are formed on the upper end of the side-wall thereof, and a circular groove 6 is defined between said two flanges. The thread 8 for engagement with the thread 2 provided on the side-wall of the opening 1 of the receptacle is formed on the inside of the side-wall of the cap 7, and above said thread 8 there is formed a circular projection 9. The outside diameter of the foregoing circular groove 6 is somewhat smaller than the inside diameter of this circular projection 9, and the outside diameter of the flanges 4, 5 is somewhat smaller than the inside diameter of the cap 7, so that when the circular groove 6 is engaged with the circular projection 9, the inside stopper 3 is capable of moving a little transversely relative to the cap 7. In this context, the top-wall of the cap 7 may be replaced with a lid 10 designed to fit in the recess 11 formed on the top of the cap.

Inasmuch as the outside diameter of the upper flange 4 is designed to be smaller than that of the lower flange 5, when the inside stopper 3 is inserted in the cap 7 from the bottom thereof, the flange 4 is applied on the back of the circular projection 9 and the flange 4 bends inwardly because it is resilient, and the circular projection 9 can be easily engaged with the circular groove 6 as shown in FIG. 1. As an alternate assembly procedure, by removing the lid 10, the inside stopper 3 can be inserted in the cap 7 from above, applying the flange 5 downwardly against the surface of the circular projection 9 and whereby the flange 5 is bent because it is resilient. The same condition of engagement between the circular projection 9 and circular groove 6 as shown in FIG. 1 can be effected.

Next, the mode of use of the cap with an inside stopper shown in FIG. 1 will be explained in the following. Inasmuch as the inside stopper 3 is fastened to the cap proper 7, at the time of applying it to the receptacle, it will do to merely screw the cap proper 7 onto the neck 1 of the receptacle. On this occasion, the inside stopper 3 moves transversely along the circular projection 9, and finally is automatically set in a position where its center completely coincides with the center of the opening 1 of the receptacle. Consequently, the exterior of the side-wall of the inside stopper 3 and the interior of the opening 1 of the receptacle completely slidingly and sealingly engage so that the liquid contained in the receptacle proper does not leak. Moreover, when the cap 7 is completely screwed tight, the circular projection 9 presses the lower flange 5 against the top face 12 of the opening 1 of the receptacle, so that the tight-sealing effect can be further enhanced.

Figure 5:
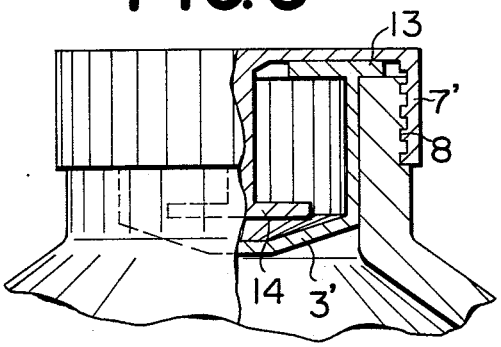
FIG. 5 is a partially cross-sectional view of a modified cap according to the invention.
Figure 6:
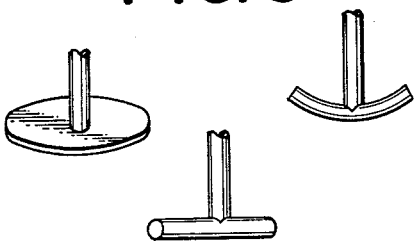
FIG. 6 is a perspective view of various hook members which constituting a part of the cap proper shown in FIG. 5 for holding the inside stopper.

The inside stopper 3' shown in FIG. 5 is also a stopper formed in one piece and it is somewhat resilient so that it can be fitted in the opening 1 of the receptacle by pressing. This inside stopper 3' is provided with a flange 13 on the upper end of the side-wall thereof. The thread 8 for engagement with the thread 2 provided on the side-wall of the neck 1 of the receptacle is formed on the interior of the side-wall of the cap 7', and the hook member 14 for holding the inside stopper is installed on the top-wall of the cap 7'. As the configuration of this hook member, varieties of configurations are conceivable, but the point is that it should be formed so as to be suitable for holding the inward extension of the flange 13 of the inside stopper 3' to prevent the inside stopper 3' from slipping out of the cap proper 7'. In this context, the outside diameter of the flange 13 is somewhat smaller than the inside diameter of the cap proper 7' so that the inside stopper 3' is movable not only vertically but also transversely to some degree relative to the cap proper.

Inasmuch as the inside diameter of the flange 13 is designed to be smaller than the transverse length of the hook member 14 for holding the inside stopper, when the flange 13 is applied to the bottom face of the hook member 14 and is pushed upwardly strongly, the flange 13 is bent as it is resilient and it is readily placed in the condition shown in FIG. 5, The mode of use of the cap with an inside stopper shown in FIG. 5 is the same as explained above with respect to FIG. 1. That is, at the time of applying it to the receptacle, it will do to merely screw the cap 7' onto the opening 1 of the receptacle. By so doing, the exterior of the side-wall of the inside stopper 3' is made to coincide with the interior of the opening 1 of the receptacle completely and the bottom face of the outward extension of the flange 13 of the inside stopper 3' is pressed against the top face of the opening 1 of the receptacle, thereby achieving an excellent tight-sealing effect.

In order to discharge the liquid contents from the receptacle equipped with a cap with an inside stopper as shown in FIG. 1 and FIG. 5, the cap is removed. On this occasion, the inside stopper 3 (or 3') is removed together with the cap 7 (or 7'). In this connection, it may happen, though very rarely, that the cap 7 alone may be removed and the inside stopper 3 (or 3') may remain in the opening 1 of the receptacle. In that event, the inside stopper 3 (or 3'), can be removed following the removal of the cap proper.

As described in the foregoing, the present invention has the practical advantage that it not only renders it possible to apply or detach the cap proper and the inside stopper simultaneously by a single motion because said cap and inside stopper are incorporated in a unitary assembly but also achieved a superb tight-sealing effect because the inside stopper is allowed to move transversely and freely within the cap and it can be completely sealed with the interior of the opening of receptacle automatically. Accordingly, the cap according the present invention is applicable to receptacles for any of such substances as liquids, solutions, powders, etc.

What is claimed is:

1. A cap assembly adapted to be threaded on the externally screw-threaded neck of a container, comprising: a cap body having a sidewall, said sidewall having an internally screw-threaded, cylindrical axially inner portion adapted to be threaded onto the neck of the container, said cap body having a radially inwardly extending wall portion located axially outwardly of said screw-threaded portion of said sidewall; an inside stopper having a cylindrical sidewall extending generally parallel to and spaced radially inwardly from said inner portion of said sidewall of said cap body and adapted to sealingly engage the internal sidewall of the central opening of the neck of the container, said sidewall of said inner stopper having an annular radially outwardly extending flange adjacent the outer end thereof disposed in radially overlapping relationship with said wall portion of said cap body, said flange extending toward the interior surface of said sidewall with the radially outer edge of said flange being radially inwardly spaced from the interior surface of said sidewall to define an annular gap therebetween so that said inner stopper can move radially relative to said cap body, said wall portion of said cap body being adapted to press said flange against the outer end of the neck of the container; and means for interlocking said cap body and said inner stopper so that they can be removed as a unit from the container.

2. A cap assembly adapted to be threaded on the externally threaded neck of a container, comprising: a cap body having a sidewall, said sidewall having an internally screw-threaded, cylindrical, axially inner portion adapted to be threaded onto the neck of the container, said cap body having a radially inwardly extending, annular projection located axially outwardly of said screw-threaded portion of said sidewall; an inside stopper having a cylindrical sidewall extending generally parallel to and spaced radially from said inner portion of said sidewall of said cap body and adapted to sealingly engage the internal sidewall of the central opening of the neck of the container, said sidewall of said inner stopper having a pair of annular, axially spaced-apart radially outwardly extending flanges adjacent the outer end thereof, said flanges defining therebetween an annular groove within which said annular projection is disposed, said flanges extending toward the interior surface of said sidewall with the radially outer edges of said flanges being radially inwardly spaced from the interior surface of said sidewall to define annular gaps therebetween and said annular projection being radially spaced outwardly from the bottom of said groove to define an annular gap therebetween so that said inner stopper can move radially relative to said cap body.

3. A cap assembly according to claim 3 in which said cap body has a lid fitted therein adjacent the outer end thereof and covering said inside stopper.

4. A cap assembly according to claim 3 in which the outside diameter of the axially outer flange is smaller than the outside diameter of the axially inner flange.

5. A cap assembly according to claim 3 in which said inside stopper is a monolithic molding of resilient thermoplastic resin.

6. A cap assembly according to claim 5 in which said inside stopper is a hollow generally cup-shaped member having a transverely extending wall spaced outwardly from the inner base wall thereof.

7. A cap assembly adapted to be threaded on the externally threaded neck of a container, comprising: a cup-shaped cap body having an axially outer base wall and a sidewall, said sidewall having an internally screw-threaded, cylindrical, axially inner portion adapted to be threaded onto the neck of the container, said base wall having an inwardly extending hook member located in the central region thereof; an inside stopper having a cylindrical sidewall extending generally parallel to and spaced radially inwardly from said inner portion of said sidewall of said cap body and adapted to sealingly engage the internal wall of the central opening of the neck of the container, said sidewall of said inside stopper defining a cavity into which said hook member extends, said inside stopper having an annular radially outwardly extending flange adjacent the outer end thereof and disposed for abutting contact with said base wall of said cap body, said flange extending toward the interior surface of said sidewall of said cap body with the radially outer edge of said flange being radially inwardly spaced from the interior surface of said sidewall to define an annular gap therebetween so that said inner stopper can move radially relative to said cap body, said inside stopper having radially inwardly extending wall portions located axially outwardly of said hook member and in radial overlapping relationship therewith so that said cap body and said inner stopper can be removed as a unit from the container.

8. A cap assembly according to claim 7 in which said inside stopper is a monolithic molding of resilient thermoplastic resin.

9. A cap assembly according to claim 8 in which said inside stopper is a hollow generally cup-shaped member.

* * * * *

UNITED STATES PATENT AND TRADEMARK OFFICE

CERTIFICATE OF CORRECTION

PATENT NO. : 4 019 646

DATED : April 26, 1977

INVENTOR(S) : MASANAGA IMAMURA

It is certified that error appears in the above-identified patent and that said Letters Patent are hereby corrected as shown below:

Column 6, line 1; "Claim 3" is changed to read

---Claim 2---.

Signed and Sealed this

*Twenty-seventh* Day of *September 19*

[SEAL]

*Attest:*

RUTH C. MASON
*Attesting Officer*

LUTRELLE F. PARKER
*Acting Commissioner of Patents and Trademark*